United States Patent [19]

Rilling

[11] 3,997,010

[45] Dec. 14, 1976

[54] DOWNHOLE FORWARD AND BACK SCUTTLING TOOL

[75] Inventor: Harry Lee Rilling, Long Beach, Calif.

[73] Assignee: Midway Fishing Tool Company, Long Beach, Calif.

[22] Filed: Mar. 1, 1976

[21] Appl. No.: 662,542

[52] U.S. Cl. ..... 175/242; 175/317

[51] Int. Cl.[2] ..... E21B 27/00; E21B 41/00

[58] Field of Search ..... 175/241, 242, 317, 291

[56] References Cited

UNITED STATES PATENTS

| | | | |
|---|---|---|---|
| 1,427,685 | 8/1922 | Hill | 175/242 |
| 1,565,906 | 12/1925 | Clinton | 175/242 |
| 1,638,337 | 8/1927 | Hutton | 175/291 |
| 2,239,586 | 4/1941 | Appleby | 175/242 |
| 2,307,658 | 1/1943 | Appleby | 175/242 |

*Primary Examiner*—James A. Leppink
*Attorney, Agent, or Firm*—William C. Babcock

[57] ABSTRACT

A down hole forward and back scuttling tool capable of being removably connected to a power driven drill string and to an expandable reamer to transmit torque from the drill string to the reamer as the latter is transversely expanded and rotated to form an elongate cavity in the lower portion of the bore hole. The reamer is of a conventional type that permits fluid under pressure to discharge therefrom. The tool during the reaming operation permits fluid under pressure to flow downwardly in a first path through the drill string, tool and reamer to exit from the latter into the cavity and then upwardly through an annulus shaped space defined between the side wall of the bore hole and drill string to the ground surface. Cuttings from the reaming operation drop downwardly due to gravity to the bottom of the cavity. It is desirable that such cuttings be removed from the cavity prior to the latter being packed with gravel. The tool permits these cuttings to be retrieved. Such retrieval is accomplished by reversing the flow of fluid under pressure and causing it to flow through a second path. Fluid under pressure as it is directed through the second path flows downwardly through the annulus into the cavity to create a turbulent condition in at least the lower portion thereof, with the cuttings being lifted from the bottom and entrained with the turbulent fluid, and the fluid with entrained cuttings flowing through ports in the tool to move upwardly through the drill string to the ground surface. A check valve in the tool prevents cuttings that have entered the drill string from moving downwardly through the tool back into the cavity.

14 Claims, 7 Drawing Figures

DOWNHOLE FORWARD AND BACK SCUTTLING TOOL

BACKGROUND OF THE INVENTION

1. Field of the Invention

Down hole forward and back scuttling tool.

2. Description of the Prior Art

In oil field operations, the lower portion of an oil well bore hole may be enlarged to define an elongate cavity by rotating a transversely expandable reamer that is secured to the lower end of a power driven drill string. Cuttings from the reaming operations drop downwardly to rest on the bottom of the cavity. Prior to a perforated liner being extended into the cavity, and the cavity filled with gravel to facilitate the production of oil, the cuttings should be removed from the cavity. In the past, the removal of the cuttings from a cavity has presented time consuming difficulties.

The primary purpose in devising the present invention is to supply a tool that may be interposed between the lower end of a drill string and the upper end of the reamer to serve not only as a torque transmitting element, but to permit the flow of fluid under pressure through either a first or second path.

The fluid, which will normally be drilling mud, flows through the first path when the drill string is rotating the expandable reamer to form the elongate cavity. Fluid as it flows through the first path, moves downwardly in a longitudinal passage in the drill string to pass through the interior of the tool and discharge through one or more openings in the reamer, and then flow upwardly from the cavity through an annulus shaped space defined between the drill string and side wall of the bore hole to the ground surface.

The fluid when it flows through a second path moves downwardly through the annulus space between the drill string and side wall of the bore hole to enter the cavity, with the fluid after it enters the cavity being in a turbulent condition, and in this condition lifting cuttings from the bottom of the cavity to entrain the cuttings with the fluid. The fluid with entrained cuttings now enters a port or ports in the reamer to flow upwardly therethrough into the interior of the tool, and from the tool through a check valve associated therewith into the interior of the longitudinal passage in the drill string. The fluid with entrained cuttings flows through the longitudinal passage in the drill string to the ground surface where the cuttings are separated from the fluid by conventional means, such as settling or the like. The check valve prevents cuttings carried into the longitudinal passage of the drill string to drop downwardly by gravity to return to the cavity in which they were initially disposed.

SUMMARY OF THE INVENTION

The down hole forward and back scuttling tool is used in combination with a source of fluid under pressure, a power driven tubular drill string having a longitudinal passage therein through which the fluid may flow, and an expandable reamer assembly. The tool is interposed between the lower end of the drill string and the upper end of the reamer, which reamer has an opening or openings therein through which the fluid may discharge.

The drill string, tool and reamer may be used in combination to form the lower end of an oil well bore hole into an elongate cavity of enlarged transverse cross-section, which cavity well subsequently will be filled with gravel prior to production of oil from the well. During the reaming operation cuttings drop downwardly and rest on the bottom of the elongate cavity.

The tool includes an elongate shell that has first and second ends on which first and second threads are defined that engage the lower threaded end of the drill string and the upper threaded end of the reamer. The shell is of sufficient strength as to transmit torque from the drill string to the reamer during the time that the latter is being rotated in an expanded position to form the elongate cavity. The shell has a longitudinally extending interior cylindrical side wall and at least one transverse port formed in the side wall thereof that is communication with the interior of the shell.

A rigid cup shaped body of non-circular transverse cross-section is provided that has a first end surface, and preferably first and second pairs of exterior side wall surfaces, and a recess that extends inwardly from the first end surface. The body is disposed within the interior of the shell, and at least one of the exterior side wall surfaces is rigidly secured to the interior cylindrical side wall of the shell. The body has at least one transverse passage therein that maintains communication between the port and recess.

The pair of second exterior side wall surfaces and the interior cylindrical side wall of the shell cooperate to define a pair of longitudinal passages therebetween through which fluid may flow from the longitudinal passage in the drill string to a longitudinal passage in the reamer.

A check valve is mounted on the first end of the body, which check valve when in a first position prevents fluid under pressure that flows downwardly through the longitudinal passage in the drill string from entering the recess. The tool selectively permits fluid to flow through a first path when the reaming operation is under way, or through a second path when it is desired to retrieve cuttings from the bottom of the cavity.

The fluid when it flows through the first path flows through the longitudinal passages in the drill string, shell and reamer and through the opening in the latter, and then upwardly to the ground surface through the annulus shaped space defined between the drill string and the side wall of the oil well bore hole. The fluid when it flows through the second path flows downwardly through the annulus shaped space previously described into the cavity to create a turbulent condition in the latter in which the cuttings are lifted from the bottom of the cavity to become entrained with the fluid. The fluid with the entrained cuttings now enters ports in the tool to flow upwardly in the tool through the check valve into the longitudinal passage in the drill string, with the fluid and cuttings subsequently being discharged at the ground surface. The check valve prevents cuttings after entering the longitudinal passage in the drill string from dropping downwardly by gravity to return to the cavity in which they were initially disposed.

DESCRIPTION OF THE PREFERRED EMBODIMENT

Figure 1:
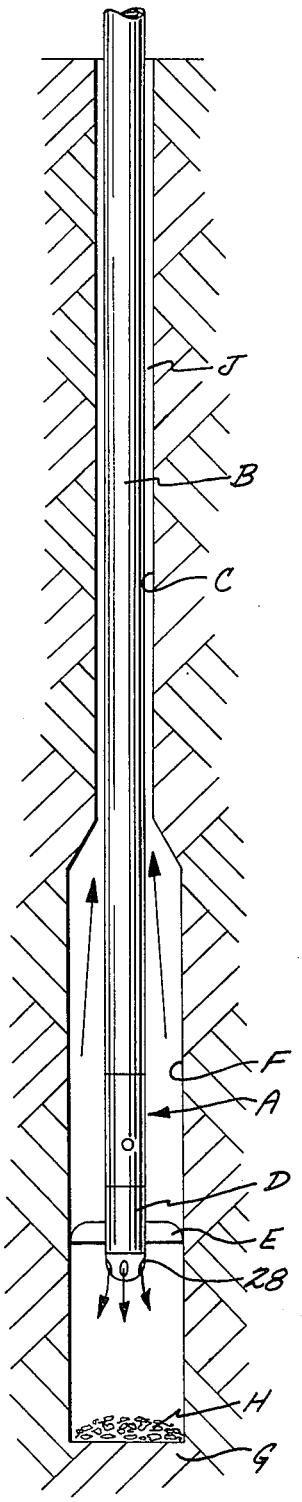
FIG. 1 is a side elevational view of the forward and back scuttling tool connected to the lower end of a drill string and the upper end of an expandable reamer, with the drill string, tool, and reamer disposed in an oil well bore hole that has had the lower portion thereof enlarged to define an elongate cavity, and with cuttings from the reaming operation resting on the bottom of the cavity.
Figure 2:
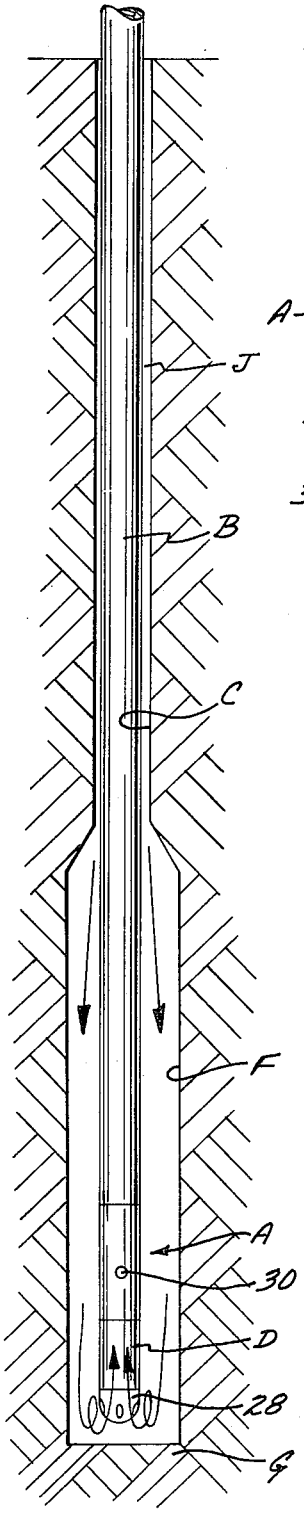
FIG. 2 is the same view as shown in FIG. 1 but with the reamer in a retracted position, and fluid being forced downwardly into the cavity to lift cutting from the bottom thereof, and the fluid with entrained cuttings being directed upwardly through the tool and a longitudinal passage in the drill string to the ground surface.
Figure 3:
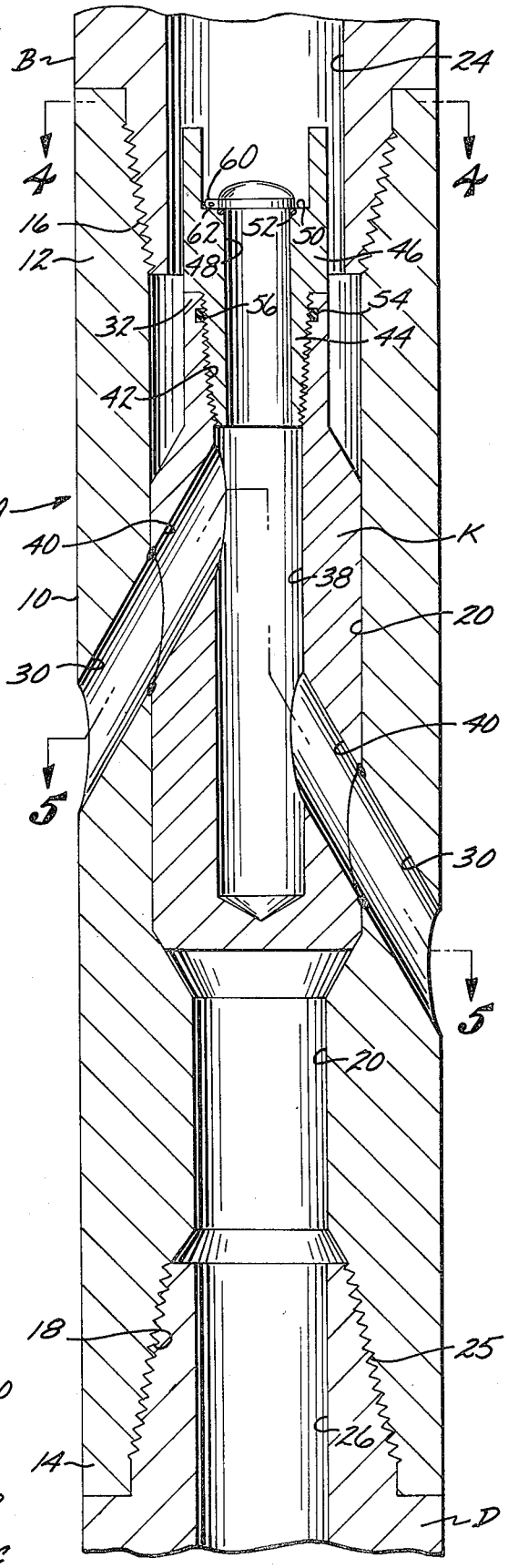
FIG. 3 is an enlarged vertical cross-sectional view of a first form of down hole forward and back scuttling tool.
Figure 4:
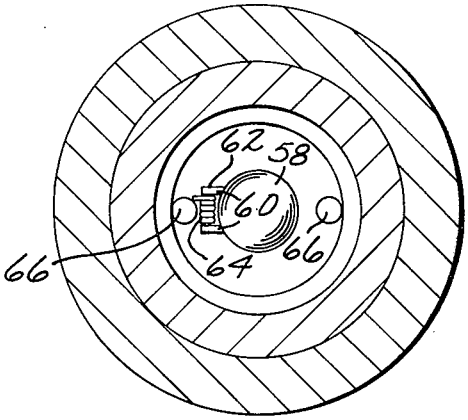
FIG. 4 is a transverse cross-sectional view of the first tool taken on the line 4—4 of FIG. 3.

The first form of tool A as may best be seen in FIG. 3 includes a cylindrical shell 10, that has a first end 12, and a second end 14. First threads 16 are defined on the first end 12 of shell 10 and second threads 18 on the second end 14 of the shell. The drill string B is of substantially less transverse cross-sectional area than that of the bore hole C, and cooperates with the side wall of the bore hole C to define an annulus shaped space J as may be seen in FIGS. 1 and 2. The shell 10 has an interior longitudinally extending cylindrical side wall 20. The first threads 16 of shell 10 engage threads 22 on the lower end of drill string B. The drill string B has a longitudinal passage 24 therein. Second threads 18 engage threads 25 formed on the upper end of reamer D. A longitudinal passage 26 is formed within reamer D through which fluid may discharge from one or more openings 28 formed in the reamer D, as best seen in FIGS. 1 and 2.

The reamer D is of conventional design and includes a number of transversely expandable blades E that may be used to transform the lower portion of the bore hole C into an elongate cavity F having a transverse cross-sectional area substantially greater than that of the bore hole. The cavity F has a bottom G onto which cuttings H drop as the reaming operation progresses. The drill string B, tool A and reamer D are concurrently rotated by conventional power means (not shown).

Figure 5:
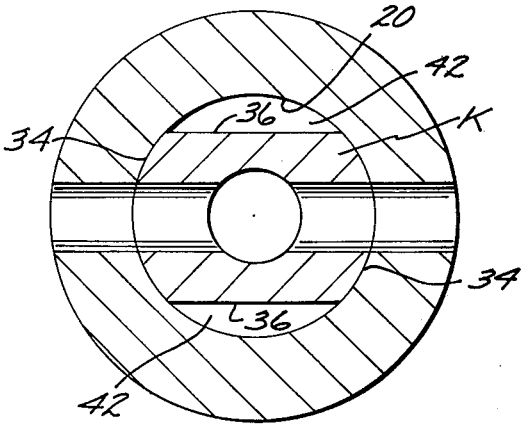
FIG. 5 is a second transverse cross-sectional view of the first tool taken on the line 5—5 of FIG. 3.

The shell 10 is illustrated in FIG. 3 as having two oppositely disposed ports 30 formed in the side wall thereof, which ports extend upwardly and inwardly. A plug K of a hard rigid material is provided that has a first upper end 32, a pair of oppositely disposed first side walls 34, and a second pair of side walls 36. The pair of first side walls 34 are in snug abutting contact with the cylindrical surface 20, as may be seen in FIGS. 3 and 5.

Body K has an elongate recess 38 therein that extends downwardly from the first end 32. Two downwardly and outwardly extending passages 40 are formed in body K. The passages 40 are axially aligned with ports 30, and at all times maintain the ports in communication with bore 48. Threaded end 44 and the portion of plug 46 on which threads 42 are formed have aligned circumferential grooves 54 therein that are occupied by a sealing ring 56. Plug 46 is of substantially less transverse cross-sectional area than the lower portion of longitudinal passage 24 into which the plug extends.

A flapper 58 has two spaced parallel arms 60 projecting therefrom that pivotally engage a pin 62 held above the surface 50 by conventional means (not shown). The flapper 58, when in a first position, is in sealing engagement with the valve seat 52, and is preferably of sufficient weight to at all times tend to so remain. If desired, the flapper 58 may have a deformed spring 64 associated therewith to maintain the flapper 58 in the first position. End surface 50 has two spaced uprights 66 projecting therefrom that may be engaged by a suitable wrench to unscrew the plug 46 from engagement with the body K. The body K is held at a fixed permanent position in the shell 10 by welding beads 68, as shown in FIG. 3 or other suitable fastening means.

Figure 7:
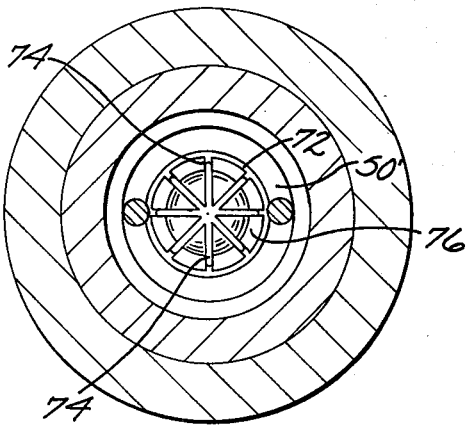
FIG. 7 is a transverse cross-sectional view of the second form of the tool taken on the line 7—7 of FIG. 6.
Figure 6:
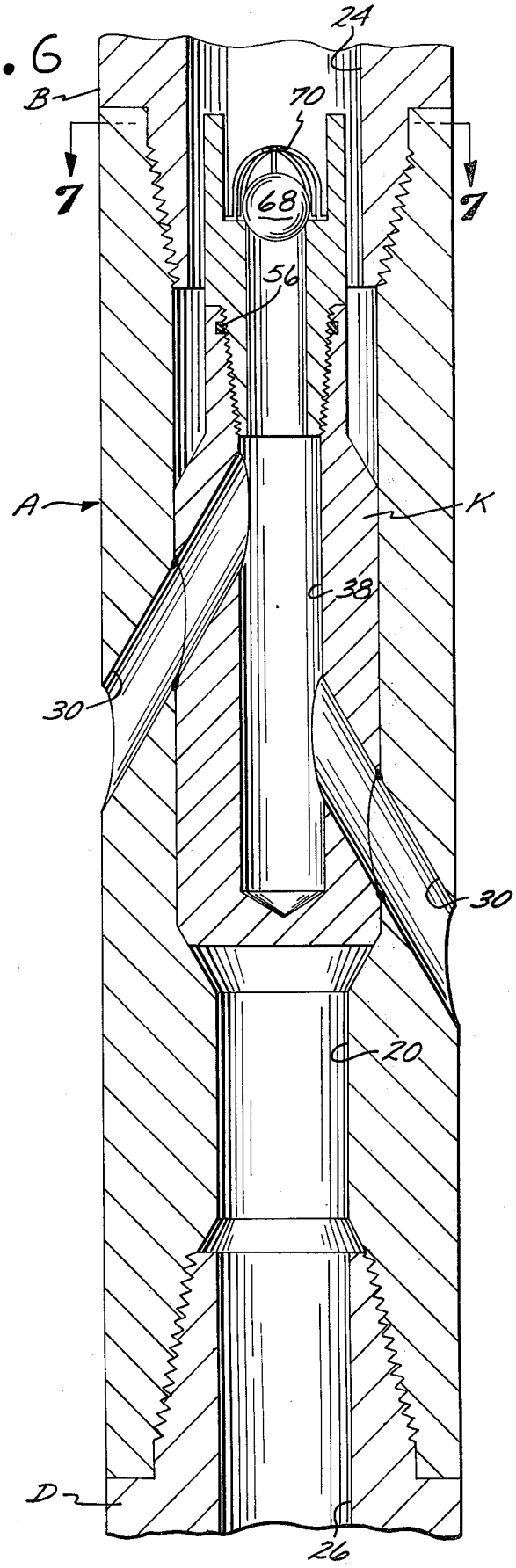
FIG. 6 is a longitudinal cross-sectional view of a second form of the tool.

A second form of the tool A′ is shown in FIGS. 6 and 7 that is identical with the first form of the tool A, other than that, the flapper 58 is replaced by a heavy ball 68 that at all times by gravity tends to remain in a first position on seat 52′ to seal the latter. Elements of the tool A′ that are common to elements in the first form of tool are identified by the same numerals and letters previously used but to which a prime is added. A cage 70 is secured to the end surface 50′ and is of sufficiently large dimensions as to not only house the ball 68 but to permit the latter to move to a second position. The cage 70 may be formed from a ring 72 secured to end surface 50′, which ring has a number of spaced bars 74 extending upwardly therefrom. The spacing 76 between the bars 74 is sufficiently large as to permit cutting H to pass upwardly therethrough when the ball 68 is in the second position.

The use of the invention is the same irrespective of whether the first form A or second form A′ thereof is used. Accordingly, only the use of the first form A will be described.

After the oil well bore hole C has been drilled, a drill string B with the tool A and reamer D supported from the lower end thereof is lowered into the bore hole. When the reamer D is disposed at a desired distance above the bottom G, the blades E are transversely expanded, and the drill string rotated. Torque from the drill string is transferred through the shell 10 to reamer D to rotate the latter. Concurrently, fluid that is preferably drilling mud is discharged downwardly under pressure through longitudinal passages 24, 42 and 26 to exit through openings 28 in the reamer D into the cavity F. Cuttings H, resulting from the reaming operation, drop downwardly by gravity to the bottom G of the cavity. The fluid, after entering the cavity F as above-described, completes a first path by now flowing upwardly to the ground surface through the annulus-shaped space C to be recirculated through the first path by power driven pump means (not shown). During the reaming operation, the reamer D, with the blades E expanded, is rotated and concurrently lowered until the cavity F is completed.

After the cavity F is completed, the rotation thereof is terminated. The fluid is now caused to flow through a second path. Fluid, as it traverses the second path, flows downwardly in the annulus-shaped space J into the cavity F. The fluid, due to the high velocity at which it is discharged into cavity F, is in a turbulent condition therein and raises the cuttings H from the bottom G. The fluid, with entrained cuttings H, enters the ports 30 of tool A to flow through passage 40 into recess 38. The fluid now forces the check valve flapper 58 to a second position that permits the fluid with entrained cuttings H to flow to the ground surface through the longitudinal passage 24 in drill string B. The cuttings H are separated from the fluid at the ground surface by conventional means (not shown).

Although the tool A has been described and illustrated in conjunction with a reamer D, the tool A is adapted to be used equally well with a drill bit or other oil well drilling or maintenance tool that is moved upwardly and downwardly to a desired location in an oil well bore by a drill string or tubing string. When the reamer D is replaced by a conventional oil well drill bit (not shown) the tool A not only serves to transmit torque from the drill string B to the bit but permits drilling mud to be forced through either the first or second paths previously described.

In the drilling of a deep well the use of the tool A is particularly advantageous. By reversing the flow of drilling mud to cause it to flow upwardly in a second path through the drill string, the drilling mud may be checked at the ground surface for traces of oil and gas to determine if the bore hole is penetrating a potential oil or gas bearing zone without the necessity of pulling the drill string.

Also, by use of the tool A, an elongate instrument such as a survey instrument or the like may be caused to move downwardly in the drill string to a desired location in the bore hole by causing the drilling mud to flow through the first path previously described. After the instrument has been actuated by remote control means to obtain a reading, the direction of the flow of the drilling mud is now reversed, with the drilling mud flowing upwardly through the drilling string, and carrying the instrument with it to the ground surface. In summary, the tool A may be used in any drilling or maintenance operation in an oil well bore hole where it is desirable to alternately direct the flow of drilling mud or other fluid through the first and second paths previously described.

The use and operation of the invention has been described previously in detail and need not be repeated.

I claim:

1. In combination with a source of fluid under pressure, a power driven tubular drill string having a longitudinal passage therein through which said fluid may flow and said drill string having a lower threaded end, and an expandable reamer assembly having a threaded upper end a longitudinal passage in said reamer and an opening in communication with said passage in said reamer through which said fluid can exit, a forward and back scuttling tool having first and second threaded ends that are connected to said lower threaded end of said drill pipe and said upper threaded end of said reamer, said drill string, tool, and reamer disposed in an oil well bore hole that has the lower portion thereof transversely enlarged by a reaming operation to define an elongate cavity having a bottom on which cuttings from the reaming operation rest, said drill string of smaller transverse area than said bore hole and cooperating with the side wall of said bore hole to define an annulus space therebetween, said forward and back scuttling tool including:

a. an elongate shell having first and second ends on which first and second threads are defined that engage said lower threaded end of said drill string and said upper threaded end of said reamer, said shell having a longitudinally extending interior cylindrical side wall, and said shell having at least one transverse port therein, said shell of sufficient strength as to permit torque to be transmitted from said drill string to said reamer to rotate the latter and form a portion of said bore hole into said elongate cavity;

b. a rigid cup-shaped body of non-circular transverse cross-section that has a first end surface, first and second exterior side wall surfaces, and a recess that extends inwardly from said first end surface, said body disposed within said shell, said body having at least one of said exterior side wall surfaces rigidly secured to said interior cylindrical side wall, said body having at least one transverse passage therein that maintains communication between said port and said recess, said second exterior side wall surface and said interior cylindrical side wall cooperating to define at least one longitudinal passage therebetween through which said fluid may flow from said longitudinal passage in said drill string to said reamer; and c. check valve means on said first end of said body which in a first position prevent said fluid under pressure that flows downwardly through said longitudinal passage in said drill string from entering said recess, with said forward and back scuttling tool selectively permitting said fluid under pressure to flow either through a first path that includes said longitudinal passages in said drill string, shell and reamer and said opening in the latter and said annulus space during the reaming operation or through a second path during the cuttings retrieving operation, said second path including downward flow of said fluid through said annulus space into said cavity in which said cuttings are disposed to create a turbulent flow of fluid in said cavity sufficient to lift said cuttings from said bottom and said cuttings become entrained with said fluid, said fluid with entrained cuttings flowing through said port into said transverse passage to enter said recess in said body and flow upwardly therefrom by moving said check valve from said first position to a second position, and said fluid with said entrained cuttings flowing upwardly in said longitudinal passage in said drill pipe to the ground surface.

2. A forward and back scuttling tool as defined in claim 1 in which the upper end of said recess in said body has threads defined thereon, and said check valve means includes:

d. an elongate plug having first and second ends, said first end having a valve seat defined thereon that is in communication with a bore that extends longitudinally through said plug, said second end of said plug having external threads thereon that engage said threads in said recess of said body, said plug of less transverse cross-sectional area than that defined by said interior cylindrical side wall of said shell; and e. a flapper pivotally supported from said first end of said plug and of sufficient weight as to at all times tend to remain in said first position.

3. A forward and back scuttling tool as defined in claim 1 in which the upper end of said recess in said body has threads defined thereon, and said check valve means includes:

d. an elongate plug having first and second ends, said first end having a valve seat defined thereon that is in communication with a bore that extends longitudinally through said plug, said second end of said plug having external threads thereon that engage said threads in said recess of said body, said plug of less transverse cross-sectional area than that defined by said interior cylindrical side wall of said shell;

e. a flapper pivotally supported from said first end of said plug; and f. spring means that at all times tend to maintain said flapper in said first position on said valve seat.

4. A forward and back scuttling tool as defined in claim 2 which in addition includes:

f. wrench engageable means that extend from said first end of said plug for unscrewing the latter from said body.

5. A forward and back scuttling tool as defined in claim 3 which in addition includes:

g. wrench engageable means that extend from said first end of said plug for unscrewing the latter from said body.

6. A forward and back scuttling tool as defined in claim 1 in which the upper end of said recess in said body has threads defined thereon, and said check valve means includes:

d. an elongate plug having first and second ends, said first end having a valve seat defined thereon that is in communication with a bore that extends longitudinally through said plug, said second end of said plug having external threads thereon that engage said threads in said recess of said body, said plug of less transverse cross-sectional area than that defined by said interior cylindrical side wall of said shell;

e. a heavy ball that at all times tends to remain in a first position in sealing contact with said valve seat; and f. a cage secured to said first end of said plug and extending around said ball, said cage of sufficient height as to permit said ball to move from said first position to a second position when said fluid and entrained cuttings flow upwardly through said bore in said plug to discharge into said longitudinal passage in said drill string.

7. A forward and back scuttling tool as defined in claim 6 which in addition includes:

g. wrench engageable means that extend from said first end of said plug for unscrewing the latter from said body.

8. A forward and back scuttling tool capable of being connected to the lower end of a tubular string having a longitudinal passage therein, said tubular string capable of being lowered into an oil well bore hole to a desired depth, said tool selectively permitting fluid to be forced through either a first path or a second path, said fluid when traversing said first path flowing downwardly through the interiors of said tubular string and tool to discharge from the latter and then flow upwardly in an annulus space defined between said bore hole and tubular string, said fluid when traversing said second path flowing downwardly through said annulus space to enter said tool and flow upwardly through the interios of said tool and tubular string to the ground surface, said tubular string having a lower threaded end portion, said forward and back scuttling tool including:

a. an elongate shell having first and second ends between which a longitudinal interior cylindrical side wall extends, said first end having first threads defined thereon that engage said threads on said lower end of said tubular string, said shell having at least one transverse port therein;

b. a rigid cup-shaped body of non-circular transverse cross-section that has a first end surface, first and second exterior side wall surfaces, and a recess that extends inwardly from said first end surface, said body disposed within said shell, said body having at least one of said exterior side wall surfaces rigidly secured to said interior cylindrical side wall, said body having at least one transverse passage therein that maintains communication between said port and said recess, said second exterior side wall surface and said interior cylindrical side wall cooperating to define at least one longitudinal passage therebetween through which said fluid may flow from said longitudinal passage in said drill string to said bore hole; and c. check valve means on said first end of said body which in a first position prevent said fluid that flows downwardly through said longitudinal passage in said tubular string from entering said recess, with said forward and back scuttling tool selectively permitting said fluid to traverse either a first path that includes downward flow of said fluid through said longitudinal passages in said tubular string and shell into said bore hole and then upwardly through said annulus space or through a second path that includes downward flow through said annulus space into said port, transverse passage, recess, and check valve when the latter is moved to a second position, into said longitudinal passage in said tubular member to flow to the ground surface.

9. A forward and back scuttling tool as defined in claim 8 in which said shell has threads defined thereon that permit said tool to be connected to the upper threaded end of an additional tubular string or to the upper threaded end of an oil well drilling or maintenance tool that has a longitudinal passage therein that is in communication with said bore hole and said upper threaded end.

10. A forward and back scuttling tool as defined in claim 8 in which the upper end of said recess in said body has threads defined thereon, and said check valve means includes:

d. an elongate plug having first and second ends, said first end having a valve seat defined thereon that is in communication with a bore that extends longitudinally through said plug, said second end of said plug having external threads thereon that engage said threads in said recess of said body, said plug of less transverse cross-sectional area than that defined by said interior cylindrical side wall of said shell; and e. a flapper pivotally supported from said first end of said plug and of sufficient weight as to at all times tend to remain in said first position.

11. A forward and back scuttling tool as defined in claim 8 in which the upper end of said recess in said body has threads defined thereon, and said check valve means includes:

d. an elongate plug having first and second ends, said first end having a valve seat defined thereon that is in communication with a bore that extends longitudinally through said plug, said second end of said plug having external threads thereon that engage said threads in said recess of said body, said plug of less transverse cross-sectional area than that defined by said interior cylindrical side wall of said shell;

e. a heavy ball that at all times tends to remain in a first position in sealing contact with said valve seat; and f. a cage secured to said first end of said plug and extending around said ball, said cage of sufficient height as to permit said ball to move from said first position to a second position when said fluid flows upwardly through said bore in said plug to discharge into said longitudinal passage in said drill string.

12. A forward and back scuttling tool as defined in claim 11 which in addition includes:

g. wrench engageable means that extend from said first end of said plug for unscrewing the latter from said body.

13. A forward and back scuttling tool as defined in claim 10 which in addition includes:

f. wrench engageable means that extend from said first end of said plug for unscrewing the latter from said body.

14. A forward and back scuttling tool that includes:

a. a cylindrical shell having first and second open ends between which a cylindrical interior side wall extends, said first end at least having threads thereon, and said shell having at least one transverse port therein;

b. a rigid cup-shaped body of non-circular transverse cross-section that has a first end surface, first and second exterior side wall surfaces, and a recess that extends inwardly from said first end surface, said body disposed within said shell, said body having at least one of said exterior side wall surfaces rigidly secured to said interior cylindrical side wall, said body having at least one transverse passage therein that maintains communication between said port and said recess, said second exterior side wall surface and said interior cylindrical side wall cooperating to define at least one longitudinal passage therebetween; and c. check valve means on said first end of said body that at all times tends to remain in a first position to seal the upper end of said recess, but said check valve means opening when fluid under pressure enters said recess through said port and transverse passage.

* * * * *